US011330365B2

(12) United States Patent
Wei et al.

(10) Patent No.: US 11,330,365 B2
(45) Date of Patent: May 10, 2022

(54) SPEAKER MODULE

(71) Applicant: MERRY ELECTRONICS(SUZHOU) CO., LTD., Suzhou (CN)

(72) Inventors: Pengjiang Wei, Suzhou (CN); Shiming Yuan, Suzhou (CN)

(73) Assignee: MERRY ELECTRONICS(SUZHOU) CO., LTD., Suzhou (CN)

( * ) Notice: Subject to any disclaimer, the term of this patent is extended or adjusted under 35 U.S.C. 154(b) by 0 days.

(21) Appl. No.: 17/185,164

(22) Filed: Feb. 25, 2021

(65) Prior Publication Data

US 2022/0053262 A1 Feb. 17, 2022

(30) Foreign Application Priority Data

Aug. 14, 2020 (CN) ..... 202010819568.1

(51) Int. Cl.

| | |
|---|---|
| ***H04R 1/28*** | (2006.01) |
| ***H04R 9/02*** | (2006.01) |
| ***H04R 9/06*** | (2006.01) |

(52) U.S. Cl.

CPC ..... *H04R 1/2826* (2013.01); *H04R 9/025* (2013.01); *H04R 9/06* (2013.01)

(58) Field of Classification Search

CPC combination set(s) only.
See application file for complete search history.

(56) References Cited

U.S. PATENT DOCUMENTS

2014/0205135 A1* 7/2014 Sakaguchi ..... H04R 9/025 381/415
2019/0014417 A1 1/2019 Qin et al.

FOREIGN PATENT DOCUMENTS

| | | | | |
|---|---|---|---|---|
| CN | 203104578 U | * | 7/2013 | |
| CN | 203859862 U | | 10/2014 | |
| CN | 208540153 U | * | 2/2019 | ..... H04R 1/227 |
| CN | 208638568 U | * | 3/2019 | |
| CN | 105659626 B | | 10/2019 | |
| CN | 110337048 A | | 10/2019 | |
| CN | 110430511 A | | 11/2019 | |
| CN | 209964287 U | | 1/2020 | |
| CN | 111183654 A | | 5/2020 | |
| KR | 100640225 B1 | * | 10/2006 | |
| WO | WO 2016/194208 A1 | | 12/2016 | |

OTHER PUBLICATIONS

Chinese Office Action and Search Report for Chinese Application No. 202010819568.1, dated Apr. 7, 2021, with an English translation.

* cited by examiner

*Primary Examiner* — Angelica M McKinney
(74) *Attorney, Agent, or Firm* — Birch, Stewart, Kolasch & Birch, LLP

(57) ABSTRACT

A speaker module includes a first cavity body, a second cavity body disposed adjacent to the first cavity body and a vibration module disposed in the first cavity body and including a first diaphragm and a second diaphragm which are horizontally spaced apart. The first cavity body includes a first sub-cavity and a second sub-cavity which are respectively located on two opposite sides of the vibration module, and the second sub-cavity is communicated with the second cavity body.

6 Claims, 3 Drawing Sheets

SPEAKER MODULE

CROSS-REFERENCE TO RELATED APPLICATION

This application claims priority to a Chinese patent application No. 202010819568.1 filed on Aug. 14, 2020, disclosure of which is incorporated herein by reference in its entirety.

TECHNICAL FIELD

The present disclosure relates to the technical field of video and audio devices, and specifically, relates to a speaker module.

BACKGROUND

At present, entertainment video and audio devices are equipped with speakers to play sound, and as the size of the entertainment video and audio device is updated, the requirements on the size of the speaker are relatively higher.

In the related art, a speaker generally includes a housing and a vibration module disposed in the housing. The vibration module includes a diaphragm, a voice coil, a magnetic circuit system and other structures. At present, due to the limitation of inner space of mobile phones and the requirement on thickness of the speaker, most of the built-in speaker modules of smart phones emit sounds from sides, so that a problem occurs, that is, a sharp acoustic peak and a sharp acoustic valley appear in the medium-high frequency curve due to resonance of the front cavity, and at the moment, the sound emitted by the speaker is relatively harsh, so that the listening feeling of the user is poor, and the practicability and applicability of the speaker are low. Therefore, a speaker module with a relatively good listening feeling at high frequency is urgently needed to provide.

SUMMARY

The present disclosure provides a speaker module, which can improve the situation that sharp peaks and valleys appear in a medium-high frequency curve of the speaker module, providing a relatively good listening feeling.

The present disclosure provides the solution described below.

A speaker module is provided. The speaker module includes: a first cavity body, a second cavity body disposed adjacent to the first cavity body and a vibration module disposed in the first cavity body and including a first diaphragm and a second diaphragm which are horizontally spaced apart.

The first cavity body includes a first sub-cavity and a second sub-cavity which are respectively located on two opposite sides of the vibration module, and the second sub-cavity is communicated with the second cavity body.

Optionally, the speaker module further includes a powder mesh structure disposed in the second sub-cavity, where the powder mesh structure is provided with a plurality of through holes.

Optionally, the powder mesh structure is located below the second diaphragm.

Optionally, the speaker module further includes a first baffle disposed between the first cavity body and the second cavity body, where one end of the powder mesh structure is connected to the first baffle, and another end of the powder mesh structure is connected to a bottom of the second sub-cavity.

Optionally, the speaker module further includes a second baffle located in the first cavity body and perpendicularly connected to the first baffle, the second baffle is provided with a mounting hole, and the second diaphragm is mounted on the mounting hole.

Optionally, the powder mesh structure, the first diaphragm and the second diaphragm are an integrally-formed structure.

Optionally, the speaker module includes a front cavity and a rear cavity, the front cavity is the first sub-cavity located above the vibration module, and the rear cavity includes the second sub-cavity located below the vibration module and the second cavity body.

Optionally, the second diaphragm includes an outer diaphragm, an inner diaphragm and a metal ring, the outer diaphragm is disposed around the inner diaphragm, and the metal ring connects the outer diaphragm and the inner diaphragm and is disposed around the inner diaphragm.

Optionally, a rigidity of the outer diaphragm is less than a rigidity of the inner diaphragm.

Optionally, the speaker module further includes a magnetic circuit system and a voice coil structure. The magnetic circuit system and the voice coil structure are both disposed in the second sub-cavity, the first diaphragm is driven by the magnetic circuit system and the voice coil structure to vibrate, and the second diaphragm is driven by the first diaphragm to vibrate.

The present disclosure provides the speaker module, due to the setting of the second diaphragm in the first cavity body, medium-high frequency of the speaker module can be adjusted through the second diaphragm, the situation that sharp peaks and valleys exist in the medium-high frequency curve of the speaker module can be improved, the sound emitted by the speaker module is not harsh, a relatively good listening feeling is provided to the user, and the practicability and applicability of the speaker module is improved; due to the setting of the powder mesh structure, foreign matters in the product can be prevented from being in contact with the second diaphragm, so as to avoid impact on sound quality. The rear cavity is directly disposed below the second diaphragm, so that the compactness of product design is improved, the space of the rear cavity is greatly increased, the low frequency is further improved, and the function of adjusting the medium-high frequency by the second diaphragm is not affected.

REFERENCE LIST

Figure 1:
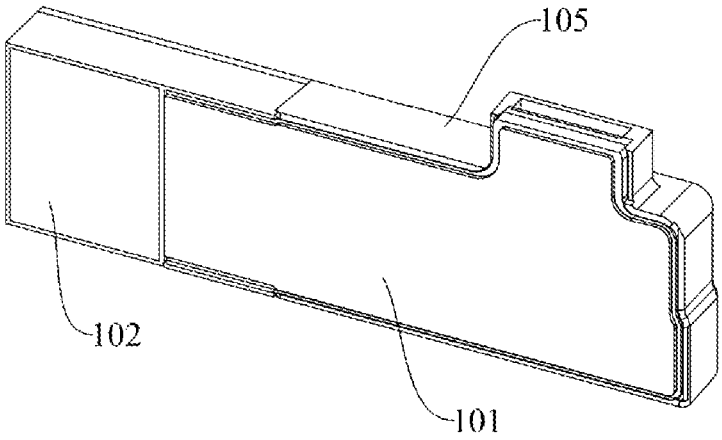
FIG. 1 is a structural view of a speaker module according to an embodiment of the present disclosure.

1 first cavity body
11 first sub-cavity

12 second sub-cavity
2 second cavity body
3 vibration module
31 first diaphragm
32 second diaphragm
4 powder mesh structure
41 through hole
5 first baffle
6 second baffle
61 mounting hole
7 magnetic circuit system
101 first plate structure
102 second plate structure
103 third plate structure
104 fourth plate structure
105 side plate structure

DETAILED DESCRIPTION

To make solved problems, adopted solutions and achieved effects of the present disclosure clearer, solutions of the present disclosure are further described below through embodiments in conjunction with drawings. It is to be understood that the embodiments described below are merely intended to illustrate and not to limit the present disclosure. In addition, it should be noted that for ease of description, only the part related to the present disclosure, instead of all, is illustrated in the drawings.

In the description of the present disclosure, it should be noted that the orientations or position relations indicated by terms such as "center", "above", "below", "left", "right", "vertical", "horizontal", "inside", "outside" and the like are based on orientations or position relations shown in the drawings. These orientations or position relations are intended only to facilitate and simplify description of the present disclosure, and not to indicate or imply that a device or element referred to must have such specific orientations or must be configured or operated in such specific orientations. Thus, these orientations or position relations are not to be construed as limiting the present disclosure. In addition, terms such as "first" and "second" are used merely for the purpose of description and are not to be construed as indicating or implying relative importance.

In the description of the present disclosure, it should be noted that unless otherwise expressly specified and limited, the term "mounting", "connected to each other" or "connected" is to be construed in a broad sense, for example, as securely connected or detachably connected; mechanically connected or electrically connected; directly connected to each other or indirectly connected to each other via an intermediary; or internally connected between two elements. For those of ordinary skill in the art, specific meanings of the preceding terms in the present disclosure may be understood based on specific situations.

An embodiment provides a speaker module, which can improve the situation that sharp peaks and valleys exist in the medium-high frequency curve of the speaker module, providing a relatively good listening feeling.

As shown in FIGS. 1 to 6, the speaker module includes a first cavity body 1, a second cavity body 2 and a vibration module 3.

The second cavity body 2 is disposed adjacent to the first cavity body 1, that is, the first cavity body 1 is adjacent to the second cavity body 2. The vibration module 3 is disposed in the first cavity body 1, and includes a first diaphragm 31 and a second diaphragm 32 which are horizontally spaced apart. The first cavity body 1 includes a first sub-cavity 11 and a second sub-cavity 12 which are respectively located on two opposite sides of the vibration module 3, and the second sub-cavity 12 is communicated with the second cavity body 2. The first sub-cavity 11 is located above the first diaphragm 31 or above the second diaphragm 32. The second sub-cavity 12 is located below the first diaphragm 31 or below the second diaphragm 32.

In this embodiment, the speaker module may include a front cavity and a rear cavity. The front cavity refers to a cavity located above the first diaphragm 31 or the second diaphragm 32, and the rear cavity refers to a cavity located below the first diaphragm 31 or the second diaphragm 32. Specifically, the front cavity is the part of the first cavity body 1 located above the vibration module 3, and the rear cavity includes the part of the first cavity body 1 located below the vibration module 3 and includes the second cavity body 2. The rear cavity of the speaker module is relatively large.

In the speaker module provided by this embodiment, due to the setting of the second diaphragm 32 in the first cavity body 1, medium-high frequency of the speaker module can be adjusted through the second diaphragm 32, so that the situation that sharp peaks and valleys exist in the medium-high frequency curve of the speaker module can be improved, the sound emitted by the speaker module is not harsh, a relatively good listening feeling is provided to the user, and the practicability and applicability of the speaker module is improved.

Moreover, due to the communication of the second sub-cavity 12 with the second cavity body 2, the volume of the second sub-cavity 12 is increased, the compactness of product design is improved, so that the first diaphragm 31 and the second diaphragm 32 can have a relatively large rear cavity, the low frequency can be further improved, and the function of adjusting the medium-high frequency by the second diaphragm 32 is not affected.

Figure 3:
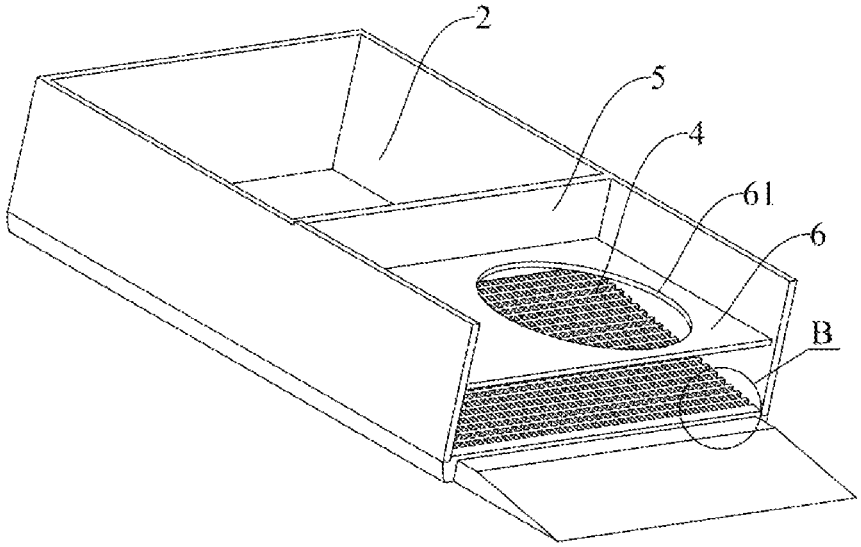
FIG. 3 is a schematic view showing a second cavity body and a powder mesh structure according to an embodiment of the present disclosure.
Figure 4:
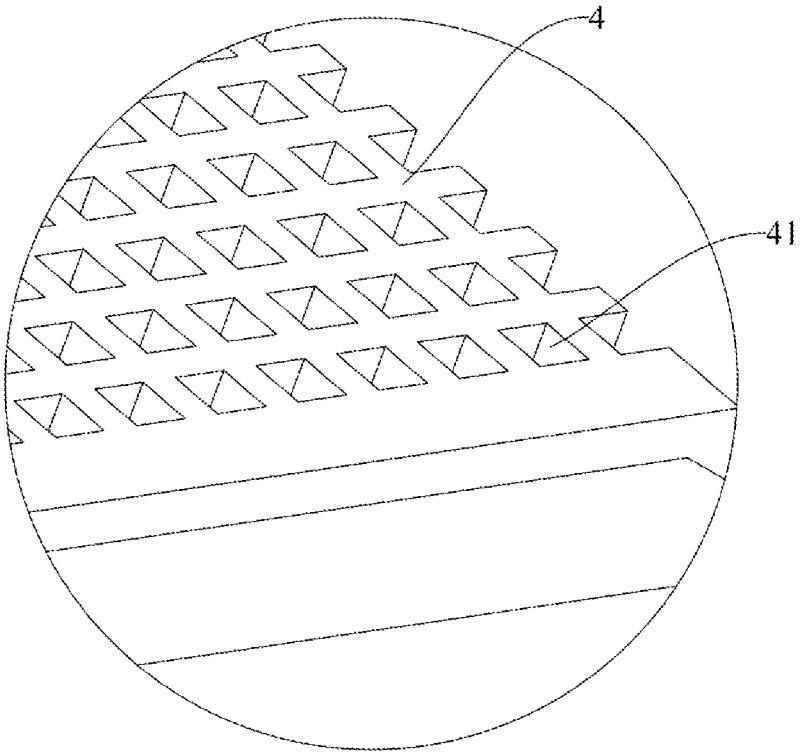
FIG. 4 is an enlarged view of position B of FIG. 3 according to the present disclosure.
Figure 5:
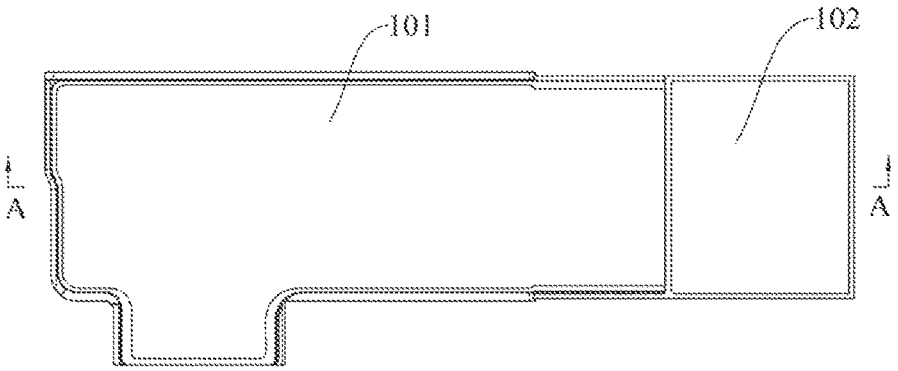
FIG. 5 is a top view of the speaker module according to an embodiment of the present disclosure.

Further, as shown in FIG. 3 and FIG. 4, the speaker module may further include a powder mesh structure 4. The powder mesh structure 4 is disposed in the second sub-cavity 12 and is provided with a plurality of through holes 41. Due to the setting of the powder mesh structure 4, ventilation between the second sub-cavity 12 and the second cavity body 2 can be increased; meanwhile, foreign matters in the product can be prevented from being in contact with the second diaphragm 32, so as to avoid impact on sound quality. In a case where the second diaphragm 32 vibrates up and down, the setting of the powder mesh structure 4 greatly improves the phenomenon that the resonance frequency of the module is too high caused by poor ventilation of bass powder. Optionally, the powder mesh structure 4 may further be located between the second sub-cavity 12 and the second cavity body 2, that is, the powder mesh structure 4 is located at junction of the second sub-cavity 12 and the second cavity body 2, which is not limited in this embodiment.

Figure 6:
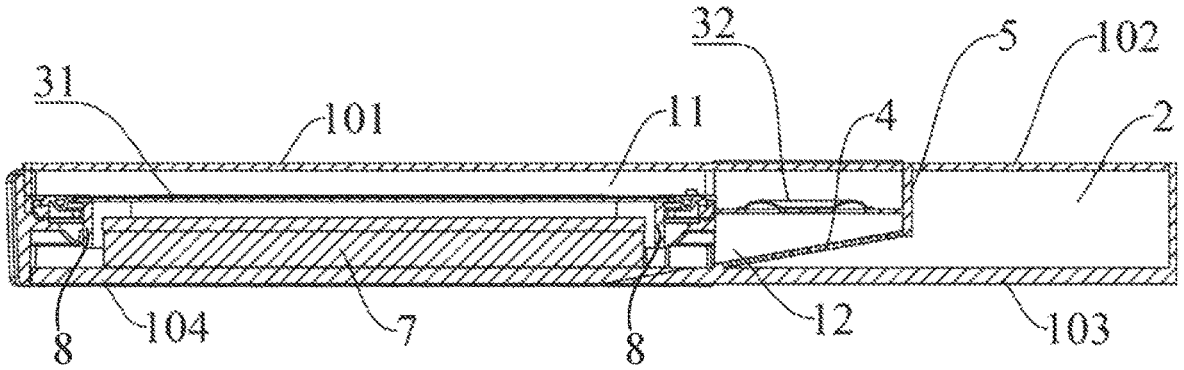
FIG. 6 is a cross-sectional view of FIG. 5 taken along A-A according to the present disclosure.

Further, as shown in FIG. 6, in a case where the powder mesh structure 4 is disposed in the second sub-cavity 12, the powder mesh structure 4 may be located below the second diaphragm 32. Specifically, the powder mesh structure 4 may be located below the second diaphragm 32. In this case, the second sub-cavity 12 may be divided into an upper cavity and a lower cavity by the powder mesh structure 4. The upper cavity and the lower cavity are communicated through the through holes 41 on the powder mesh structure 4. The lower cavity is communicated with the second cavity body 2.

Further, with continued reference to FIG. 6, a first baffle 5 is disposed between the first cavity body 1 and the second cavity body 2. the first sub-cavity 11 and the second sub-cavity 2 are separated by the first baffle 5, and the first baffle 5 can extend into the second sub-cavity 12. One end of the powder mesh structure 4 is connected to the first baffle 5. Specifically, the one end of the powder mesh structure 4 is connected to the part of the first baffle 5 located on the second sub-cavity 12, and the other end of the powder mesh structure 4 is connected to a bottom of the second sub-cavity 12. That is, the powder mesh structure 4 is obliquely disposed in the second sub-cavity 12.

Optionally, referring to FIG. 1 and FIG. 6, the speaker module includes a first plate structure 101, a second plate structure 102, a third plate structure 103, a fourth plate structure 104 and a side plate structure 105. The first plate structure 101, the fourth plate structure 104, one part of the third plate structure 103 and one part of the side plate structure 105 are connected to form the first cavity body 1; and the second plate structure 102, the other part of the third plate structure 103 and the other part of the side plate structure 105 form the second cavity 2. The first baffle plate 5 is securely connected to the first plate structure 101 and the second plate structure 102, and the other end of the powder mesh structure 4 is securely connected to the part of the third plate structure 103 forming the second cavity 2.

Optionally, as shown in FIG. 3, the speaker module may further include a second baffle 6 located in the first cavity body 1 and perpendicularly connected to the first baffle 5. The second baffle 6 is further securely connected to the side plate structure 105. The second baffle 6 is provided with a mounting hole 61, and the second diaphragm 32 is mounted on the mounting hole 61. Moreover, the powder mesh structure 4 is located below the second baffle 6, and an orthographic projection of an edge of the powder mesh structure 4 on the second baffle 6 can be located within or coincide with the second baffle 6.

Further, the powder mesh structure 4, the first baffle 5 and the second baffle 6 are an integrally-formed structure. That is, the powder mesh structure 4, the first baffle 5 and the second baffle 6 may be formed in one manufacturing process to improve the connection strength between the powder mesh structure 4, the first baffle 5 and the second baffle 6, so as to prevent the second baffle 6 from being separated from the powder mesh structure 4 or the first baffle 5 in a case where the second diaphragm 32 vibrates.

Optionally, the structure of the second diaphragm 32 may be various, and the structure of the second diaphragm 32 in this embodiment is described below. Specifically, the second diaphragm 32 may include an outer diaphragm, an inner diaphragm and a metal ring. The outer diaphragm is disposed around the inner diaphragm, and the metal ring connects the outer diaphragm and the inner diaphragm and is disposed around the inner diaphragm. In this embodiment, the metal ring is bonded to the outer diaphragm and the inner diaphragm through a pressure sensitive adhesive (PSA).

Optionally, a rigidity of the outer diaphragm is less than a rigidity of the inner diaphragm. That is, the rigidity of the outer diaphragm is different from the rigidity of the inner diaphragm.

Figure 2:
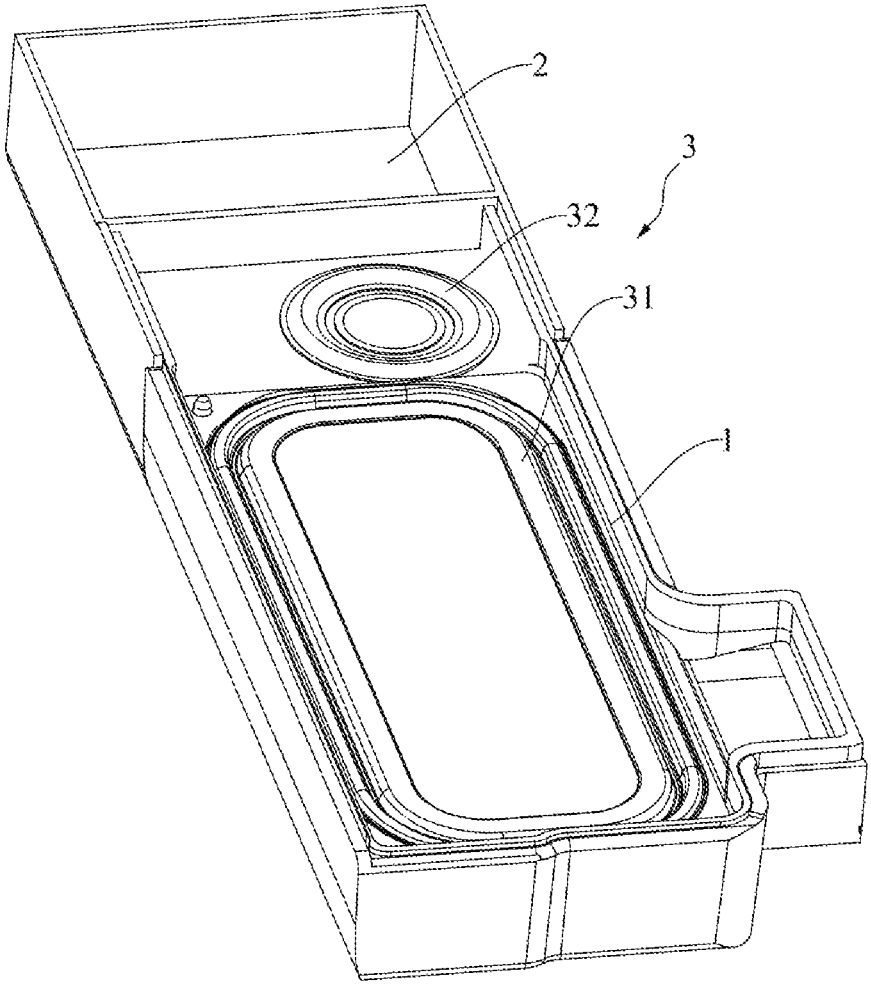
FIG. 2 is a structural view of the speaker module with a first diaphragm and a second diaphragm shown according to an embodiment of the present disclosure.

To enable the first diaphragm 31 and the second diaphragm 32 to operate normally, as shown in FIG. 6, the speaker module may further include a magnetic circuit system 7 and a voice coil structure 8. The magnetic circuit system 7 and the voice coil structure 8 are both disposed in the second sub-cavity 12, the first diaphragm 31 is driven by the magnetic circuit system 7 and the voice coil structure 8 to vibrate, and the second diaphragm 32 is driven by the first diaphragm 31 to vibrate. Specifically, in a case where the first diaphragm 31 vibrates, surrounding air is driven to vibrate, after the air being driven to vibrate, vibration is transmitted to the second diaphragm 32, and the second diaphragm 32 can be driven to vibrate. Optionally, as shown in FIG. 2, the speaker module may be in a long strip shape, the first diaphragm 31 and the second diaphragm 32 may be disposed spaced apart along a length direction of the speaker module, and the first diaphragm 31 and the second diaphragm 32 may be located on the same horizontal plane.

According to the speaker module provided by the present disclosure, the situation that sharp peaks and valleys exist in medium-high frequency curve can be improved, providing a relatively good listening feeling. Due to the setting of a powder mesh structure, ventilation between the second sub-cavity and the second cavity body can be increased; meanwhile, foreign matters in the product can be prevented from being in contact with the second diaphragm, so as to avoid impact on sound quality. A rear cavity is directly disposed below the second diaphragm, so the compactness of product design is improved, the space of the rear cavity is greatly increased, the low frequency is further improved, and the function of adjusting the medium-high frequency by the second diaphragm is not affected.

What is claimed is:

1. A speaker module, comprising:

a first cavity body; a second cavity body, which is disposed adjacent to the first cavity body; and a vibration module, which is disposed in the first cavity body and comprises a first diaphragm and a second diaphragm which are horizontally spaced apart;

a powder mesh structure, which is disposed in a second sub-cavity, located below the second diaphragm, and provided with a plurality of through holes;

a first baffle, which is disposed between the first cavity body and the second cavity body, wherein one end of the powder mesh structure is connected to the first baffle, and another end of the powder mesh structure is connected to a bottom of the second sub-cavity; and a second baffle, which is located in the first cavity body and perpendicularly connected to the first baffle, wherein the second baffle is provided with a mounting hole, and the second diaphragm is mounted on the mounting hole, wherein the first cavity body comprises a first sub-cavity and the second sub-cavity which are respectively located on two opposite sides of the vibration module, and the second sub-cavity is communicated with the second cavity body.

2. The speaker module according to claim 1, wherein the powder mesh structure, the first baffle and the second baffle are an integrally-formed structure.

3. The speaker module according to claim 2, further comprising a front cavity and a rear cavity, wherein the front cavity is the first sub-cavity located above the vibration module, and the rear cavity comprises the second sub-cavity located below the vibration module and the second cavity body.

4. The speaker module according to claim 2, further comprising a magnetic circuit system and a voice coil structure, wherein the magnetic circuit system and the voice coil structure are both disposed in the second sub-cavity, the first diaphragm is driven by the magnetic circuit system and the voice coil structure to vibrate, and the second diaphragm is driven by the first diaphragm to vibrate.

5. The speaker module according to claim 1, further comprising a front cavity and a rear cavity, wherein the front cavity is the first sub-cavity located above the vibration module, and the rear cavity comprises the second sub-cavity located below the vibration module and the second cavity body.

6. The speaker module according to claim 1 further comprising a magnetic circuit system and a voice coil structure, wherein the magnetic circuit system and the voice coil structure are both disposed in the second sub-cavity, the first diaphragm is driven by the magnetic circuit system and the voice coil structure to vibrate, and the second diaphragm is driven by the first diaphragm to vibrate.

* * * * *